United States Patent [19]

Bytniewski et al.

[11] 4,126,017

[45] Nov. 21, 1978

[54] METHOD OF REFRIGERATION AND REFRIGERATION APPARATUS

[75] Inventors: Joseph Bytniewski, Grenoble; Patrice Chovet, Bernin; Jean-Pierre Gabillard, Sassenage; Roger Prost, Saint Egreve, all of France

[73] Assignee: L'Air Liquide, Societe Anonyme pour l'Etude et l'Exploitation des Procedes Georges Claude, Paris, France

[21] Appl. No.: 717,288

[22] Filed: Aug. 24, 1976

[30] Foreign Application Priority Data

Aug. 26, 1975 [FR] France ..... 75 26204

[51] Int. Cl.[2] ..... F25B 19/00

[52] U.S. Cl. ..... 62/514 JT

[58] Field of Search ..... 62/514 JT

[56] References Cited

U.S. PATENT DOCUMENTS

| | | | |
|---|---|---|---|
| 2,991,633 | 7/1961 | Simon | 62/514 JT |
| 3,095,711 | 7/1963 | Wurtz, Jr. | 62/514 JT |
| 3,256,712 | 6/1966 | Makowski | 62/514 JT |
| 3,320,755 | 5/1967 | Jepson et al. | 62/514 JT |
| 3,415,078 | 12/1968 | Liston | 62/514 JT |
| 3,728,868 | 4/1973 | Longsworth | 62/514 JT |

*Primary Examiner*—Ronald C. Capossela
*Attorney, Agent, or Firm*—Young & Thompson

[57] ABSTRACT

A miniature open circuit refrigerator of the Joule-Thompson type, functions as a demand cryostat by virtue of a pressure-operated refrigerant supply control. The refrigerant fluid under high pressure is introduced at a first relatively rapid flow rate into the cryostat through a calibrated opening that is fully open during the initial or start-up period of the device, for rapid cool down. This calibrated opening is thereafter at least partially closed by a valve which is urged open by a spring and which is urged closed, against the action of the spring, by a bellows containing a gas at high pressure and which is exposed on its outer side to at least a portion of the pressure of the refrigerant fluid. Upon the fall in pressure of the stored refrigerant fluid, toward the end of the start-up, the bellows expands so as at least partially to close the valve, thereby to decrease the flow of refrigerant during the final portion of the cool-down period and during the steady state or on-stream operation of the device. The invention is particularly applicable for the rapid cool down of infrared detection probes.

15 Claims, 13 Drawing Figures

METHOD OF REFRIGERATION AND REFRIGERATION APPARATUS

BACKGROUND OF THE INVENTION

The present invention relates to supplying refrigerant to a miniature open-circuit refrigerator. In this connection, the invention relates on the one hand to a method of supplying refrigerant to such a refrigerator, and on the other to any refrigeration apparatus which includes an open-circuit refrigerator making use of the said method.

The refrigerators considered in the context of the present invention are capable of employing refrigeration cycles, such as the Joule-Thompson cycle, in which cooling energy is produced by the isenthalpic expansion of a working refrigerant fluid.

Such refrigerators operate by the expansion of a working refrigerant fluid, that is to say they employ either at least one isenthalpic expansion or at least one expansion which is of both an isenthalpic and isentropic nature.

A refrigerator contains a working circuit which has on the one hand an inlet for the working refrigerant fluid, which is intended to be connected, by means of a connecting valve for example, to a reservoir for supplying refrigerant fluid at high pressure, and on the other hand an outlet for the said refrigerant fluid once it has expanded, which outlet communicates freely with the atmosphere outside the refrigerator, or with a receptacle for recovering the expanded refrigerant fluid.

The present invention is involved in broad terms with the starting-up phase of the refrigerators defined above and will now be illustrated by reference to an open-circuit refrigerator of the Joule-Thompson type.

By the "starting-up phase" of a refrigerator is meant, by contrast with the working phase proper of the refrigerator, that brief period of operation during which, simply by the refrigerator being put into operation, the cold temperature or temperatures generated alter and drop from an initial level close to the ambient temperature around the refrigerator to a final level substantially equal to the rated cold temperature or temperatures which the aforesaid refrigerator is designed, calculated and dimensioned to generate.

Consequently, "working phase" thus means the period during which the refrigerator is in stable and steady operation and which immediately succeeds the starting-up phase defined above, and during which the cold temperature or temperatures generated remain steady and equal to the rated cold temperature level defined above.

In general terms, open-circuit refrigerators of the Joule-Thompson type comprise:

a heat-exchanger which has on the one hand a first duct for the working refrigerant fluid, which is at a high pressure, and on the other hand a second duct for the expanded refrigerant fluid, which is at a low pressure, the first and second ducts being in a heat-exchanging relationship one with the other, a member for isenthalpic pressure release, such as a calibrated orifice, whose upstream end communicates with the said first duct, a chamber for expanding the refrigerant fluid to the low pressure, and in particular for collecting the said fluid, the fluid possibly being at least partly condensed following the said expansion. This chamber communicates with the downstream end of the said pressure-release member and with the second duct of the said heat-exchanger. It is in this expansion chamber that the cooling energy produced by the refrigerator becomes available.

In certain cases such refrigerators also include a means of regulating the cooling energy produced, in which case the following are provided, generally speaking:

a pressure-release member capable of regulating the throughput of expanded refrigerant fluid, which has on the one hand a seating provided with an expansion orifice, and on the other a needle-valve which, in conjunction with the said orifice, defines a pressure-release passage for the working refrigerant fluid, one of these two members (the seating and the needle-valve) being movable relative to the other, which is fixed.

a direct-acting regulating means which consists of a temperature-sensitive regulating container holding a charge of a fluid capable of expanding under the effect of temperature, at least a part of which is in heat-exchanging relationship with at least the second duct from the said heat exchanger. This container is at least partly bounded by a bellows of which one end is fixed and the other is movable, with the movable end controlling the movement of the movable part of the pressure-release member as a function of the temperature reached in the said regulating container.

For certain applications in which miniature refrigerators of the Joule-Thompson type are used the duration of the starting-up phase is too long even when it lasts only something of the order of ten seconds.

In general, as in this particular case, the length of the starting-up phase depends chiefly on:

the total amount of metal in the refrigerator. The larger this amount the greater the thermal inertia of the refrigerator and the longer the starting-up phase.

the mean cooling energy produced by the refrigerator during the starting-up phase which is generated by the isenthalpic expansion of the working refrigerant fluid. The greater this energy the shorter the starting-up phase.

These are the two chief parameters on which the length of the starting-up phase depends. In effect, for a given low pressure representing the pressure to which the refrigerant fluid is expanded during the working phase, which may be atmospheric pressure for example, the nature of the said refrigerant fluid is selected as a function of its own boiling point at the above-mentioned low pressure and to suit the rated cold temperature level or levels which the refrigerator is required to generate. Consequently, the nature of the working refrigerant fluid is selected once and for all as a function of the design characteristics of the refrigerator.

By reducing the amount of metal in the refrigerator it is thus possible, in theory, to shorten the starting-up phase. In fact, this amount of metal cannot be reduced to any major degree in practice without having a substantial effect on the effectiveness and reliability of the refrigerator. Thus, the first duct of the heat-exchanger of an open-circuit Joule-Thompson refrigerator generally consists of a relatively thick coiled tube, given the relatively high working pressure of the working refrigerant fluid while the refrigerator is starting-up, which may be of the order of 400 bars for example. The thickness of the tube cannot normally be reduced below a certain figure without a danger of the said coiled tube rupturing.

To increase the mean cooling energy produced by the refrigerator during the starting-up phase with a selected working refrigerant fluid, it is possible:

either to increase the throughput of working refrigerant fluid which is expanded during the starting-up phase, or to increase the ratio in which the working refrigerant fluid is expanded at the pressure-release member of the refrigerator.

In the first case, if it is desired to bring about an automatic increase in the throughput of refrigerant fluid during the starting-up phase, this entails adding to the refrigerator either a regulating means similar to the one described above, i.e. a means which consists of a temperature-sensitive regulating container, or else a second high-pressure supply duct which takes the place of or is connected in parallel with the first duct during the starting-up or cooling-down phase. This however involves a commensurate increase in the mass of the refrigerator and thus in its thermal inertia and in this way part of the benefit gained from the larger expansion throughout is lost.

In the second case, since the low operating pressure of the refrigerator is generally designed to be equal to atmospheric pressure, the ratio of expansion at the pressure-release member can be increased only by raising the high pressure of the working refrigerant fluid, i.e. by increasing the pressure in the reservoir which supplies the refrigerant fluid. This however in turn entails a considerable increase in the thickness of the walls of the said reservoir and/or the use of materials of high mechanical strength. This being the case the supply reservoir becomes a very expensive piece of equipment.

The present invention thus has as an object to enable an open-circuit refrigerator, in particular one of the Joule-Thompson type, to be started-up quickly, and for this to be possible without affecting the design of the refrigerator used, that is to say without any substantial changes to its structure and operation.

SUMMARY OF THE INVENTION

In accordance with the invention, during a first part of the cooling-down period the supply circuit of the refrigerator is supplied with a fluid of high cooling ability and, during a second part it is supplied with a fluid of less high cooling ability. In one manner of carrying out the method, the fluid of high cooling ability is fed into the input to the single gas-supply duct at a higher pressure than that of the fluid of less high cooling ability. The fluids of higher and less high cooling abilities are of the same kind or alternatively the fluid of higher cooling ability may be less volatile than the fluid or less high cooling ability.

The inventon also consists in apparatus of the kind which has, in an insulated housing, a single supply duct which ends in a calibrated orifice which opens into an expansion chamber and an outfeed duct which is arranged to be in a heat-exchanging relationship with the said supply duct, and outside the said housing at least one storage enclosure for a fluid at high pressure and means for making a connection between the said enclosure and an inlet to the said single supply duct, which apparatus is characterised in that it includes a second enclosure and a system for directly (i.e. with no major pressure loss) and sequentially connecting, to the said refrigerator, on the one hand the said storage enclosure for a fluid at high pressure solely during the cooling down period, and on the other hand the said second enclosure at least during the phase which follows cooling-down.

In a first embodiment of this apparatus, the first enclosure for a fluid at high pressure is an auxiliary container for supplying starting-up fluid at high pressure while the second enclosure is a reservoir at medium pressure.

In a preferred form of this first embodiment of the invention:

the arrangement for supplying refrigerant to the refrigerator includes in a known fashion a valve for connecting the refrigerant-fluid supply reservoir to the input to the working circuit of the refrigerator, the sequential connecting system thus enables firstly at least the container for supplying auxiliary fluid to be connected to the connecting valve during the starting-up phase of the refrigerator, and then at least the reservoir to be connected to the valve during the operating phase of the refrigerator.

Depending on the nature of the auxiliary fluid selected, and on the pressure to which the above-mentioned container is filled, the latter may be filled either with a single-phase auxiliary fluid, such as one entirely in gaseous form, or with a multi-phase auxiliary fluid such as one partly in liquid form. In the latter case the cooling energy generated during the starting-up phase of the refrigerator will be greater.

The present invention may be put into practice in one or other of the following two ways:

(1) The auxiliary container is filled with an auxiliary starting-up fluid of the same kind as the working refrigerant fluid filling the aforementioned reservoir, and the pressure in the container is higher than that in the reservoir.

(2) The auxiliary container is filled with an auxiliary starting-up fluid which is of a different kind from, and less volatile than, the working refrigerant fluid filling the aforementioned reservoir. In this case the pressure in the container need not be any specific one and in particular may be the same as that in the reservoir. By way of example, the working refrigerant fluid may be nitrogen and the auxiliary starting-up fluid may be at least one of the following substances, namely, argon, methane and freon.

In the first case there is nothing to prevent an increase in the pressure to which the container is filled since the volume of auxiliary fluid contained in it is merely sufficient for all, or at least part, of the starting-up phase to take place and is thus a volume substantially smaller than that of the reservoir for supplying refrigerant fluid, this reservoir taking care of the whole of the working phase of the refrigerator. In other words, since the auxiliary container is much smaller than the main reservoir, it is economically possible to strengthen the walls of the former so that it is able to withstand a higher pressure than that prevailing in the latter.

In the second case, it is in itself surprising to be able to use an auxiliary starting-up fluid which is less volatile than the working refrigerant fluid. In fact it might have been feared that the auxiliary fluid would remain in the form of a residue in the circuit of the refrigerator during the working phase and consequently would upset or prevent the normal operation of the said refrigerator by solidifying and blocking its working circuit, in particular at the point where the pressure-release member is situated.

In fact, if the operation of an open-circuit Joule-Thompson refrigerator as defined above for example is considered, the following favourable fact will be realised.

When the refrigerant fluid comes into use at the beginning of the working phase of the refrigerator, it has an effective scavenging action in the working circuit of the refrigerator and the residual quantities of auxiliary fluid therefore soon become infinitesimal. Consequently, even if, during the working phase, the temperature at which the auxiliary fluid solidifies is reached in the cold part of the working circuit of the refrigerator, the partial pressure of the said auxiliary fluid is not normally sufficient to cause a solid phase to come into being.

Nevertheless, the nature of the auxiliary fluid needs to be selected in relation to the nature of the refrigerant fluid so that the former does not solidify at a temperature which is too high in relation to the liquefaction temperature of the latter.

"Fluid", as understood in the context of the present invention, means any pure substance or mixture of pure substances, whether it be the working refrigerant fluid or the auxiliary starting-up fluid. When the auxiliary fluid is a mixture of pure substances it is more volatile than the refrigerant fluid, provided its mean boiling point is higher than the boiling point of the refrigerant fluid, or than the mean boiling point of the refrigerant fluid if the latter is a mixture of pure substances.

In a second manner of putting the method into practice, the second enclosure is a supply cylinder which is connected to the refrigerator by a valve and to the first enclosure by means of communication in which the pressure loss is adjustable. Advantageously the means of communication with the first enclosure consist of an orifice which cooperates with a needle valve which is subject to the opposing actions of an opening spring and a bellows which causes at least partial closure, the said bellows being connected by a calibrated communicating orifice to the high pressure in the first enclosure, or to a pressure derived from the said high pressure.

BRIEF DESCRIPTION OF THE DRAWINGS

In order that the invention may be more clearly understood, reference will now be made to the accompanying drawings which show certain embodiments thereof by way of example, and in which.

DETAILED DESCRIPTION OF PREFERRED EMBODIMENTS

Figure 1:
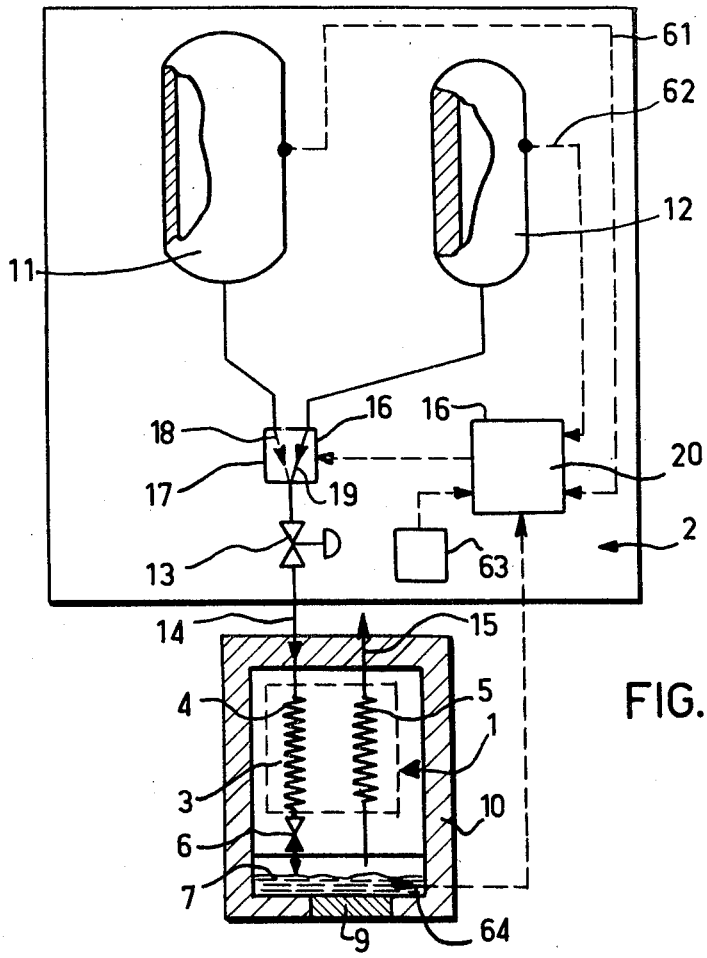
FIG. 1 is a diagram of a refrigerating system or arrangement according to the present invention.

Referring now to the drawings, the refrigerating system which is shown in FIG. 1 consists firstly of an open-circuit refrigerator 1 of the Joule-Thompson type, and secondly of a refrigerant supply arrangement 2.

In a known fashion, the refrigerator 1 consists of:

(a) a heat-exchanger 3 which has on the one hand a supply duct 4 for the flow of a working refrigerant fluid at high pressure, and on the other an outfeed duct 5 for the same fluid once expanded to a low pressure, the first duct 4 and the second duct 5 being in a heat-exchanging relationship with one another, (b) a member 6 for isenthalpic pressure-release, such as an expansion valve or a calibrated orifice, which communicates at its upstream end with duct 4, and (c) a chamber 7 for expanding the refrigerant fluid to the low pressure, and in particular for collecting the fluid when it is in an at least partly condensed form as a result of the pressure-release at member 6. This chamber 7 communicates with the downstream end of the pressure-release member 6 and with the duct 5 of heat-exchanger 3.

Consequently, reading in the direction in which the working refrigerant fluid flows, the working circuit of the refrigerator 1 consists of the duct 4 of exchanger 3, the pressure-release member 6, the expansion chamber 7, and the duct 5 of exchanger 3. The input and output of this working circuit are the input 14 to duct 1 and the output 15 from duct 5 respectively.

The cooling energy produced by the refrigerator 1 becomes available at the expansion chamber 7, in the form of a volume of working refrigerant fluid in condensed form at its boiling temperature. This cooling energy is absorbed by a piece of equipment 9 which is to be kept cold, which may be an infra-red detector for example, and which is attached to the end-wall of the expansion chamber of the refrigerator 1.

The refrigerator 1 is of course arranged in a suitable thermally insulating shell 10.

The refrigerant supply arrangement 2 consists of:

(a) a first auxiliary container 12, which is used to supply the refrigerator 1 during the starting-up phase and is filled with an auxiliary starting-up fluid (such as argon) which may be at a pressure higher than 400 bars for example, (b) a second enclosure formed by a main reservoir 11, which is used to supply the refrigerator 1 and is filled with the aforementioned working refrigerant fluid (such as nitrogen) which is at a pressure of 400 bars for example, (c) a valve 13 for connecting the reservoir 11 and the auxiliary container 12 to the refrigerator 1. Consequently, this valve 13 is connected to the input 14 to the refrigerator 1, while the outpt 15 from the refrigerator is in free communication with the outside air, and (d) a system 16 for sequentially connecting, to the connecting valve 13, firstly the auxiliary container 12 during the starting-up phase of the refrigerator 1, and then the main reservoir 11 during the working phase of the refrigerator 1.

The system 16 for sequential connection in turn consists of:

(a) a change-over device 17 having two positions 18 and 19, in which the main reservoir 11 and the auxiliary container 12 are respectively placed in communication with the connecting valve 13, and (b) a member 20 for controlling the change-over device 17, which may be of the pneumatic, hydraulic or electronic type.

The control member 20 preferably consists of a differential pressure sensor which has connections 61 and 62 to the main reservoir 11 and the auxiliary container 12 respectively. The differential sensor 20 is sensitive to a difference between the pressure in reservoir 11 and that in container 12, and it causes the reservoir 11 to be connected to the connecting valve 13, by means of the change-over device 17, when the aforesaid difference is of a predetermined, positive value.

The control member 20 may of course be actuated by signals from any other sources such as a timer 63, or a temperature probe 64 which is arranged in the expansion chamber 7 of the refrigerator 1.

Consequently, in FIG. 1 the volume of the main reservoir 11 is substantially greater than that of the auxiliary container 12 and, since the pressure to which container 12 is filled is higher than that in the main tank 11, the wall of the former is much thicker than that of the latter. It should also be noted that the main reservoir 11 and the auxiliary container 12 are connected to the connecting valve 13 is parallel via the two positions change-over device 17.

Figure 2:
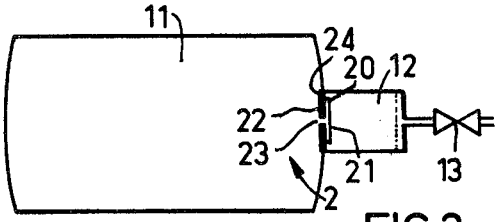
FIG. 2 is a diagram of a modified embodiment of the refrigerant supply arrangement which forms part of the refrigerating system shown in FIG. 1.

The refrigerant supply arrangement 2 shown in FIG. 1 may be very simply constructed in the manner illustrated in FIG. 2.

The supply arrangement 2 in this Figure has in fact the following constructional features:

(a) the auxiliary container 12 and the main reservoir 11 are connected in series with the connecting valve 13, which means that reservoir 11 is connected to the connecting valve 13 via container 12, (b) the differential pressure sensor 20 consists simply of an obturator foil 21 situated between container 12 and reservoir 11. The foil is arranged and gauged to rupture when the above-mentioned difference between the pressure in reservoir 11 and that in container 12 is of a predetermined, positive value. To be more exact, the differential pressure sensor 20 includes a relatively thick and stiff partition 22 through which a calibrated orifice 23 passes, and this partition acts as a support for the foil 21, which is of relatively small thickness at all points of its cross-section and is situated on the same side as container 12, and (c) the container 12 and the reservoir 11 have a common wall 24 against which the obturator foil 21 is arranged. Container 12 is arranged on the outside of reservoir 11.

Figure 3:
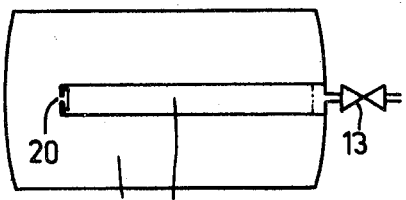
FIG. 3 is a diagram of another embodiment of the refrigerant supply arrangement shown in FIG. 2, FIGS. 4 and 5 are graphs of temperature against time and pressure against time respectively and relate to the operation of the refrigerator which forms part of the refrigerating system shown in FIG. 1.

The arrangement shown in FIG. 3 differs from that shown in FIG. 2 only in the fact that the auxiliary container 12 is arranged on the inside of the main reservoir 11, and this being the case the latter is bounded by its own wall and that of container 12.

Figure 4:
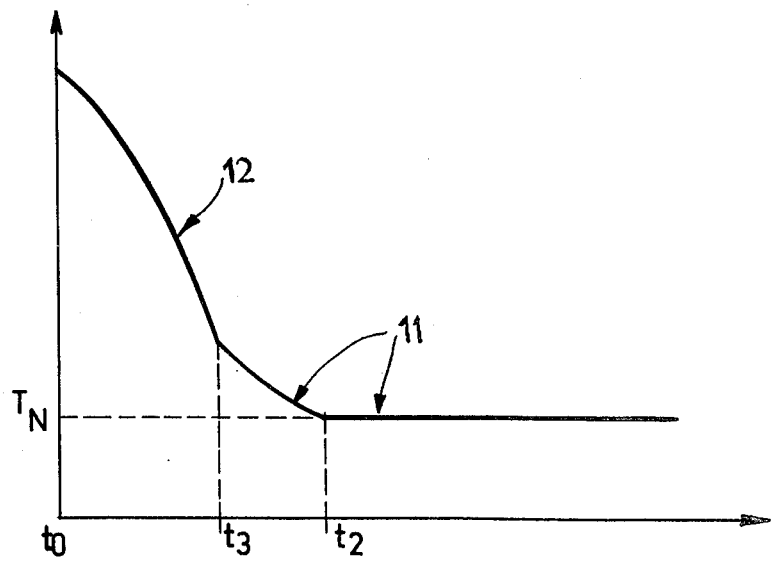
Figure 5:
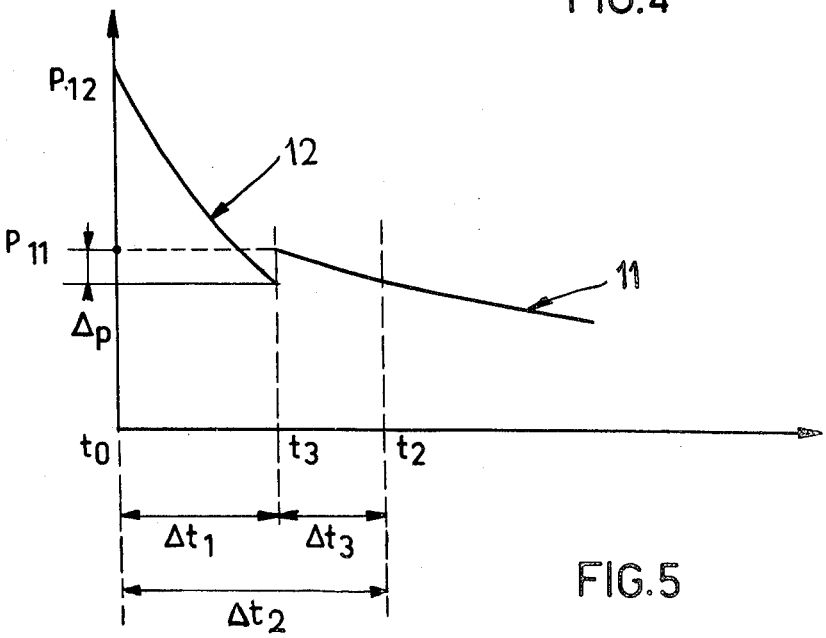

Referring to FIGS. 4 and 5, there will now be described the operation of the refrigeration system shown in FIG. 1, which may possibly be constructed using the lay-outs in FIGS. 2 and 3. At the time origin $t0$, it is assumed that:

(i) the whole mass of metal in the refrigerator 1 is at ambient temperature. Consequently there is no refrigerant fluid present in condensed form in the expansion chamber 7, (ii) reservoir 11 and container 12 are filled with, respectively, a working refrigerant fluid (such as nitrogen) and an auxiliary starting-up fluid (such as argon). Container 12 is at a considerably higher pressure than reservoir 11, and (iii) by construction (see FIGS. 2 and 3) or by means of a change-over device (see reference 17 in FIG. 1) the auxiliary container 12 is connected to the connecting valve 13.

At time $t0$, valve 13 is opened. As a result only the auxiliary container 12 is connected to the input 14 to the working circuit of refrigerator 1. During the period $\Delta t1$ between times $t0$ and $t3$, the refrigerator operates solely with the auxiliary starting-up fluid of which the characteristics have been defined above. This means that, during period $\Delta t1$, the instantaneous cooling energy produced by the refrigerator 1 results from the isenthalpic expansion of the auxiliary fluid at member 6. Bearing in mind the properties of the fluid which were emphasised hereinabove, the cold temperature generated, i.e. the temperature prevailing in expansion chamber 7, falls rapidly as shown by the graph in FIG. 4. At the same time the pressure in the auxiliary container 12 also falls rapidly from a value $p12$, as shown in the graph in FIG. 5.

At time $t3$, the pressure in the auxiliary container 12 is lower than that prevailing in the main reservoir 11 and is different from the latter by an amount $\Delta p$. This amount corresponds to the predetermined, positive reference value which is allotted for the differential pressure sensor 20 to cause the main reservoir 11 to be connected to the connecting valve 13. Consequently, at time $t3$, the differential sensor 20 triggers the change-over device 17 to position 18 in the case of FIG. 1 or, in the case of FIGS. 2 and 3, the foil 21 becomes detached or tears, thus putting reservoir 11 in communication with connecting valve 13 via container 12. Consequently, for a very short period starting from time $t3$, the working refrigerant fluid from reservoir 11 scavenges the working circuit of the refrigerator 1, thus removing any residual amounts of auxiliary starting-up fluid.

From time $t3$, the refrigerator 1 operates solely with the working refrigerant fluid supplied by reservoir 11. Thus, beginning from time $t3$, the cooling energy produced by the refrigerator 1 results exclusively from the isenthalpic expansion of the said refrigerant fluid at member 6. As shown by the graph in FIG. 4, the cold temperature generated by the refrigerator 1 continues to fall during the period $\Delta t3$, but less rapidly than during the preceding period $\Delta t1$, given that the refrigerant fluid is less efficient than the auxiliary fluid, as was mentioned above. In a corresponding fashion, after time $t3$ the pressure in the main reservoir falls gradually from a value $p11$, as shown in the graph in FIG. 5.

At time $t2$, the cold temperature generated by the refrigerator 1 reaches its rated value TN, and the level of working refrigerant fluid, in liquid form, in the expansion chamber 7 of the refrigerator 1 remains virtually constant. Consequently, the starting-up phase of the refrigerator is at an end and its working phase proper begins from time $t2$.

In conclusion, as shown in FIGS. 4 and 5, the operation of the refrigerator 1 consists of a starting-up phase represented by the period $\Delta t2$ between times $t0$ and $t2$, and a working phase which begins from time $t2$. The starting-up phase $\Delta t2$ in turn consists of a period $\Delta t1$ during which the refrigerator 1 operates with the auxiliary starting-up fluid, and a period $\Delta t3$ during which the refrigerator operates with the working refrigerant fluid.

Figure 6:
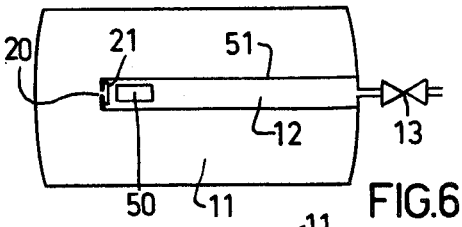
FIG. 6 is a diagram of a particular embodiment of the refrigerant supply arrangement shown in FIG. 3.

The refrigerant supply arrangement 2 shown in FIG. 6 makes it possible for the auxiliary starting-up fluid to be removed in an improved fashion from the working circuit of the refrigerator 1 as soon as the main reservoir 11 is connected to the connecting valve 13. For this purpose:

(a) the auxiliary container 12 consists of a cylinder, (b) a movable piston 50 is fitted and arranged inside the cylinder 51, and (c) a calibrated passage of small cross-sectional area is arranged in the cross-sectional area common to cylinder 51 and piston 50 and consists either of at least one calibrated orifice which passes through piston 50 longitudinally, or of a calibrated gap between cylinder 51 and piston 50.

Before foil 21 ruptures, piston 50 is situated at that end of cylinder 51 nearer to the obturator foil 21. Consequently, as soon as the latter ruptures, i.e. when reservoir 11 is connected to connecting valve 13 via container 12, piston 50 is thrust back to the opposite end of cylinder 51 from foil 21 under the pressure exerted by the auxiliary working fluid, which is temporarily higher than that of the auxiliary starting-up fluid remaining in container 12. This piston effect thus makes an effective contribution to forcing all the auxiliary fluid out of the working circuit of the refrigerator 1.

Figure 7:
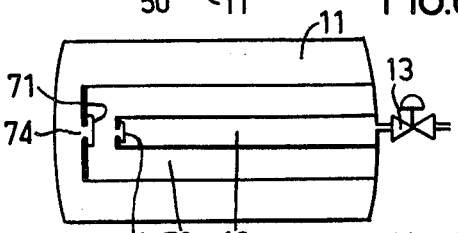
FIG. 7 is a diagram of another particular embodiment of the supply arrangement shown in FIG. 3.

The supply arrangement shown in FIG. 7 allows the starting-up phase of the refrigerator 1 to take place with two different auxiliary fluids which are used in succession. To this end, there is provided, inside the main reservoir 11, in addition to container 12, another container 73 which contains a further auxiliary fluid. The wall of the further container 73 is thus situated between the wall of reservoir 11 and the wall of container 12. In other words, reservoir 11 encloses the further container 73, which in turn encloses container 12. Also, reservoir 11 is connected to the connecting valve 13, via the further container 73 and container 12 in succession.

Also, the obturator foil 21 is now designed to rupture when the difference between the pressure in the further container 73 and that in container 12 is of a positive value, while another obturator foil 71 is provided between reservoir 11 and the further container 73 and is designed to rupture when the difference between the pressure in reservoir 11 and that in the further container 73 is of a predetermined, positive value.

The pressures to which container 12, the further container 73, and reservoir 11 are filled are of descending magnitudes.

The supply arrangement 2 shown in FIG. 7 thus enables first container 12, then the further container 73, and finally reservoir 73 to be connected automatically and successively to connecting valve 13.

Figure 8:
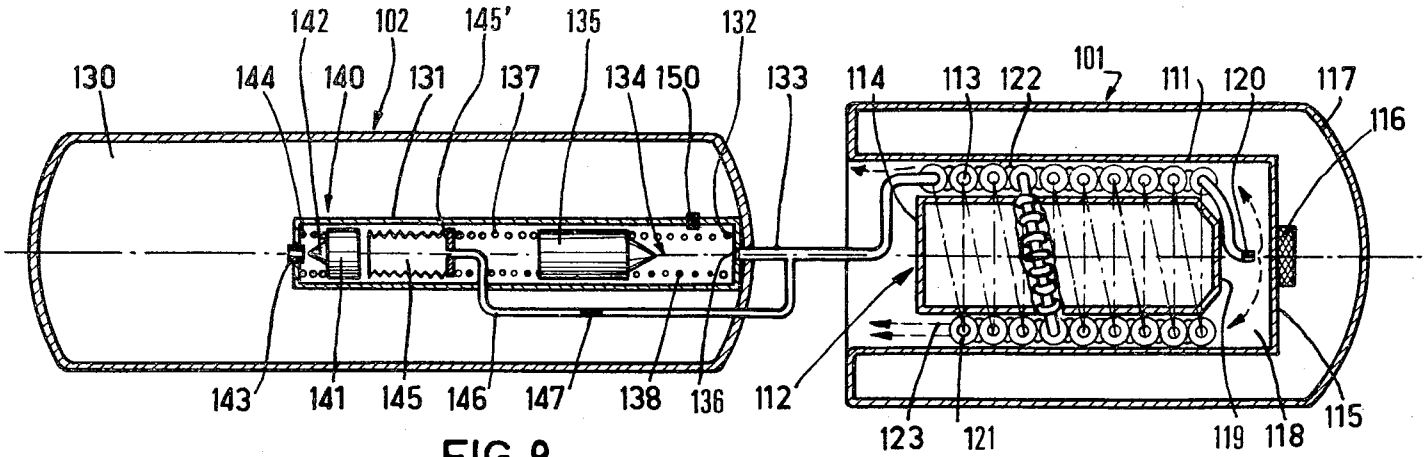
FIG. 8 is a schematic view of a refrigeration apparatus according to the invention.

Referring to FIG. 8, it can be seen that a refrigerating apparatus consists chiefly of on the one hand a refrigerator proper 101 and on the other hand of an arrangement 102 for supplying it with gas.

In the present case, the refrigerator 101 is formed by an insulating housing 111 having a core 112, around which a supply duct 113 is coiled between a hot transverse end-wall 114 and a cold transverse end-wall 115, against which is positioned a cold probe 116, which may be an infra-red radiation detector, the whole assembly being thermally insulated by a shell 117. The supply duct 113 opens into an expansion chamber 118 arranged between one end 119 of the core 112 and the cold wall 115 and it has at its end a pressure-release orifice 120.

On the outside the supply duct 113 has a large number of heat exchange fins 121 and the various turns of the coil are spaced apart by a distance band 122. In this way there are formed a high pressure supply duct in coil-form and, starting from the expansion chamber, an outlet duct 123 which is formed in the annular gap between the housing 111 and the core 112 and which is left open by the supply duct 113. This outlet duct is thus formed in a close heat-exchanging relationship with the supply duct 113 and opens freely into the atmosphere on the side at which the hot end-wall 114 is situated.

The gas supply arrangement 102 of the refrigerator 101 consists in essence, inside the high-pressure reservoir 130, of a supply cylinder 131, of which one end-wall 132 is situated facing a connecting pipe 133 which is connected to the supply duct of refrigerator 101.

At the downstream end the supply cylinder 131 has an inertia-operated valve 134 which is formed by a massive needle-valve 135 which is adapted to slide in cylinder 131. It slides opposite a rupturable diaphragm 136 which forms a part of the wall 132 at the point where pipe 133 is situated. This massive needle-valve 135 is normally held in equilibrium by two oppositely-acting springs 137 and 138. It should be noted that the massive needle-valve 135 is so shaped as to allow the gases to flow past it longitudinally with no appreciable pressure loss.

At the upstream end is formed a cooling-down valve 140 which is formed by a sliding valve member 141 which has a needle pint 142 situated facing a calibrated orifice 143 which communicates with reservoir 130.

Valve 140 is subject on the one hand to the action of a compression spring 144, and on the other to the action of an axial bellows 145 which is attached at 145' to cylinder 131. Bellows 145 is connected, by a pipe 146 which incorporates a calibrated pressure-release orifice 147, to pipe 133 immediately downstream of the rupturable disphragm 136.

In addition, the supply cylinder 131 has a calibrated orifice 150 which communicates with the interior of reservoir 130.

The operation of the refrigeration apparatus is as follows, beginning with a thermal state corresponding to ambient temperature; initially, reservoir 130 needs to be filled with gases such as nitrogen and argon at very high pressure and when reservoir 130 is pressurised by means of an inlet device which is not shown, valve 140 is moved to the right into the open position with no great opposition from the bellows 145, which is at atmospheric pressure via pipes 146, 133, 113 and 123, and is thus in the compressed position. Supply cylinder 131 is thus filled with gas at the pressure in reservoir 130 which comes both through calibrated orifice 150 and through calibrated orifice 143, the latter however being distinctly wider than orifice 150.

At the time when cooling-down is to begin, the refrigeration apparatus is subjected to an acceleration in the axial direction of the supply arrangement, towards the left of the drawing. The result is that the massive needle-valve 135 moves towards the right, which causes diaphragm 136 to be ruptured and pipe 133 and supply duct 113 to rise immediately to high pressure, the latter being supplied at a maximum rate of throughput since on the one hand calibrated orifice 150 is permanently open, and on the other calibrated orifice 143 is wide open, or is so at least at the beginning since the rise in pressure in pipe 133, when transmitted back through pipe 146, is considerably retarded by calibrated orifice 147. After a certain time, which corresponds to the normal time taken by the refrigerator to cool down, bellows 145 has risen practically to the same pressure as reservoir 130, so that valve member 141 closes calibrated orifice 143 and thus causes a considerable reduction in the flow of gas since this flow is now restricted solely to the flow through calibrated orifice 150.

Figure 10:
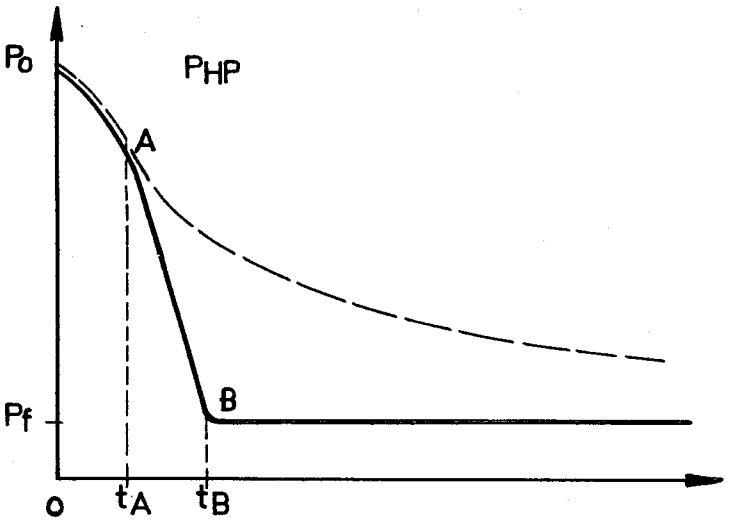
FIGS. 9 and 10 are graphs of temperature and pressure respectively as a function of time in the cold area of the refrigerating apparatus at the entry to the duct for supplying gas at high pressure.
Figure 9:
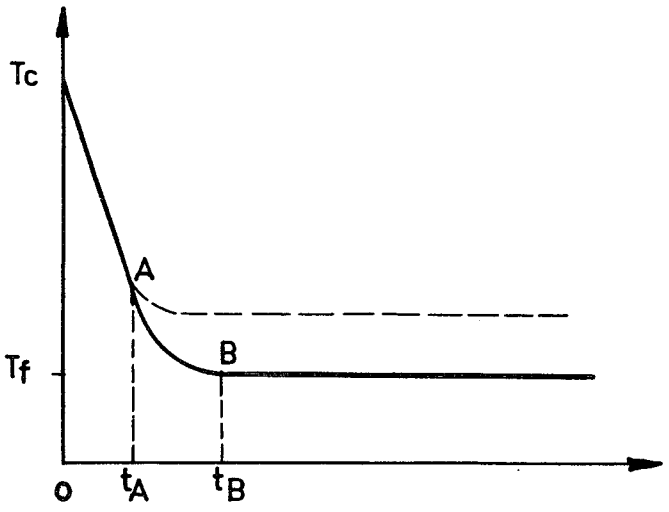

By virtue of the arrangement which has just been described, there is thus caused (see FIGS. 9 and 10) on the one hand a rapid fall in temperature during the time 0 to *t*A (*t*A representing the closure of orifice 143) and a slight drop in pressure at the entry to pipe 133 (FIG. 10) due to the slight reduction in pressure in reservoir 130, and on the other hand, during the time which elapses between *t*A and *t*B, a considerable reduction in pressure at the entry to supply duct 113, owing to the lowering of pressure resulting from the sudden drop in throughput, which corresponds to a fall in temperature which attains the steady temperature level T*f* corresponding to pressure P*f* when the throughput of gas through supply duct 113 steadies at its new minimum value. A rapid fall in temperature is thus ensured under the most satisfactory conditions and it is also ensured that the requisite low temperature is obtained.

Figure 11:
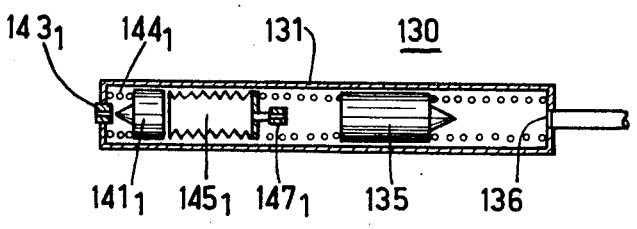
FIGS. 11, 12 and 13 are partial views of three different embodiments of a refrigerant supply arrangement according to the invention.

In a modified embodiment shown in FIG. 11 the supply cylinder 131 is fitted with a bellows $\mathbf{145_1}$ which communicates via a calibrated orifice $\mathbf{147_1}$ with the interior of supply cylinder 131. Also, a calibrated orifice such as 150 in FIG. 8 is dispensed with. Operation is different in that before cooling-down begins the bellows $\mathbf{145_1}$ is at the high pressure in reservoir 130, with valve member $\mathbf{141_1}$ in the fully open position under the prompting of compression spring $\mathbf{144_1}$ and bellows $\mathbf{145_1}$ is in the semi-inflated position. When cooling down begins, valve member 135 ruptures diaphragm 136 and as a result there is a heavy flow of gas through orifice $\mathbf{143_1}$ and then the orifice at 136. For a very short time, which represents substantially the cooling down period of the refrigerator, the high pressure in the reservoir tends to fall markedly but because of orifice $\mathbf{147_1}$ the pressure in bellows $\mathbf{145_1}$ follows the drop in pressure in reservoir 130 with a certain delay, which means that the effect of bellows $\mathbf{145_1}$ now becomes predominant in the closure direction. This is because, any time during the emptying of reservoir 130 (which means a gradual lowering of pressure) the pressure inside the bellows — which acts in the direction in which valve member $\mathbf{141_1}$ closes — is always slightly higher than the counter-pressure (which is equal to the pressure in container 131) which acts on valve member $\mathbf{141_1}$ in the direction in which it opens. A minimally open position is thus reached which represents a steady supply to the refrigerator.

Figure 12:
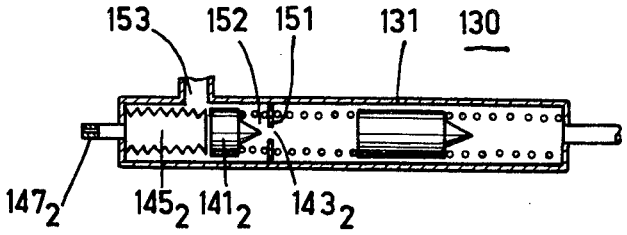

The embodiment shown in FIG. 12 is distinguished from that in FIG. 11 by the fact that the arrangement of the combination of valve member $\mathbf{141_2}$ — bellows $\mathbf{145_2}$ and calibrated orifice $\mathbf{143_2}$ is reversed in the axial direction, the calibrated orifice $\mathbf{143_2}$ being formed in a transverse partition wall 151 which defines an upstream cylinder 152 in the supply cylinder which is in permanent communication via a wide orifice 153 with reservoir 130. The bellows $\mathbf{145_2}$ is in direct communication with reservoir 130 via calibrated orifice $\mathbf{147_2}$. In operation, at the beginning of the cooling-down period, there is a high throughput of gas through orifices 153 and $\mathbf{143_2}$, valve member $\mathbf{141_2}$ being in the fully opened position as before. After a brief period, there is a more and more marked fall in the pressure in reservoir 130 and bellows $\mathbf{145_2}$ inflates somewhat, owing to a certain predominance on the part of its internal pressure over the external pressure in chamber 152, this inflation causing needle-valve $\mathbf{141_2}$ to occupy the minimally open position during the whole of this fall in pressure.

Figure 13:
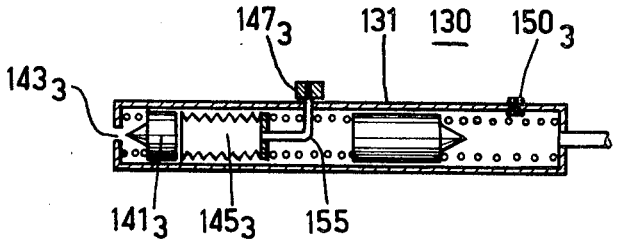

The embodiment in FIG. 13 has the feature, in comparison with the embodiment in FIG. 11, that the bellows $\mathbf{145_3}$ is now in direct communication with reservoir 130 via pipe 155 and orifice $\mathbf{147_3}$. It will be appreciated that in this case the movement of valve member $\mathbf{141_3}$ towards the minimally open position is amplified as a result of the fact that the pressure inside bellows $\mathbf{145_3}$ is a pressure derived directly from the high pressure in reservoir 130, whereas in the embodiment in FIG. 11 the pressure inside the bellows was derived from the pressure inside the supply cylinder 131, which is lower than that in reservoir 130 because of the pressure loss which takes place at calibrated orifice $\mathbf{143_3}$.

If things are so adjusted that the minimally open position of valve member $\mathbf{141_3}$ corresponds to calibrated orifice $\mathbf{143_3}$ being completely closed, then an orifice $\mathbf{150_3}$ is provided which allows a minimum sustaining throughput to pass.

The present invention covers all modifications which are within the capacity of the man skilled in the art. Thus, to give an example, instead of using an inertia-operated valve it is equally possible to use a valve of the electromagnetic type or the electropneumatic type, or the pyrotechnic type.

We claim:

1. Refrigeration apparatus comprising a Joule-Thompson refrigerator, a container for refrigerating fluid under high pressure, means for conveying said fluid from said container to said refrigerator, an orifice communicating between the interior of said container and said conveying means, a valve for at least partially closing said orifice, an expansible chamber which is exposed on its outer side to at least a portion of the pressure in said container and which upon expanding at least partially closes said valve, whereby upon an increase in the pressure within said expansible chamber relative to the pressure outside said expansible chamber, said valve is moved by said expansible chamber in a direction at least partially to close said orifice thereby to decrease the flow of said fluid to said refrigerator after an initial period of rapid cool down of said refrigerator.

2. Apparatus as claimed in claim 1, and a valve disposed between said orifice and said refrigerator.

3. Apparatus as claimed in claim 2, said valve comprising an inertia valve including a massive needle adapted to rupture a diaphragm thereby to place said orifice in fluid communication with said refrigerator.

4. Apparatus as claimed in claim 1, said expansible chamber comprising a bellows.

5. Apparatus as claimed in claim 1, and spring means urging said valve toward open position.

6. Apparatus as claimed in claim 1, and means interconnecting the interior of said expansible chamber with said conveying means.

7. Apparatus as claimed in claim 6, said interconnecting means including a calibrated delaying orifice substantially smaller than the first-mentioned orifice, whereby when said conveying means is subjected to at least a portion of the pressure of said refrigerant fluid, a portion of said refrigerant fluid will flow through said delaying orifice into said expansible chamber to expand said expansible chamber.

8. Apparatus as claimed in claim 1, and a cylinder which slidably supports said valve and which also supports said orifice, said cylinder comprising a portion of said conveying means.

9. Apparatus as claimed in claim 8, and a delaying orifice through which the interior of said expansible chamber communicates with the interior of said cylinder, said delaying orifice being substantially smaller than the first-mentioned said orifice.

10. Apparatus as claimed in claim 8, and a calibrated delaying orifice through which the interior of said expansible chamber communicates with the interior of said container outside said cylinder, said delaying orifice being substantially smaller than the first-mentioned said orifice.

11. Apparatus as claimed in claim 10, said valve being disposed in said cylinder upstream of said first-mentioned orifice.

12. Apparatus as claimed in claim 10, said valve being disposed in said cylinder downstream of said first-mentioned orifice.

13. Apparatus as claimed in claim 8, and a valve disposed between said cylinder and said refrigerator.

14. Apparatus as claimed in claim 13, said valve comprising a massive needle mounted for sliding movement in said cylinder and a rupturable diaphragm mounted on and closing said cylinder from said refrigerator.

15. Apparatus as claimed in claim 1, said refrigerator comprising a cryostat and said container being a closed container containing a finite amount of said refrigerating fluid.

* * * * *